US005564240A

United States Patent [19]

Dean, Jr.

[11] Patent Number: 5,564,240

[45] Date of Patent: Oct. 15, 1996

[54] EDGING BLOCK, AND METHOD OF ENCLOSING AN AREA UTILIZING A SERIES OF EDGING BLOCKS

[75] Inventor: Robert W. Dean, Jr., Shorewood, Wis.

[73] Assignee: Innovative Concrete Design Corp., Shorewood, Wis.

[21] Appl. No.: 217,061

[22] Filed: Mar. 24, 1994

[51] Int. Cl.[6] ..... E04C 1/00

[52] U.S. Cl. ..... 52/309.1; 52/561; 47/33; 47/86

[58] Field of Search ..... 52/608, 309.1, 52/561; 404/41, 42; 47/33, 83, 86

[56] References Cited

U.S. PATENT DOCUMENTS

| | | | |
|---|---|---|---|
| 510,259 | 12/1893 | Higgins | 404/41 X |
| 986,395 | 3/1911 | King | 47/33 |
| 1,977,021 | 10/1934 | Spencer | 47/33 |
| 3,418,774 | 12/1968 | Kocher et al. | 52/561 |
| 5,163,777 | 11/1992 | Krueger et al. | 404/41 |

FOREIGN PATENT DOCUMENTS

| | | | |
|---|---|---|---|
| 194347 | 2/1923 | United Kingdom | 404/41 |

*Primary Examiner*—Carl D. Friedman
*Assistant Examiner*—Beth A. Aubrey
*Attorney, Agent, or Firm*—Andrus, Sceales, Starke & Sawall

[57] ABSTRACT

A landscape edging or border block has an essentially trapezoidal shape, and is capable of being used to form a linear, serpentine or combination border or edge. The blocks can also be used to enclose an area. By orienting each block such that its inner edge faces inwardly, a substantially circular shape is attained to enclose a circular area. To expand the area to be enclosed, at least two expansion blocks are added for each quadrant of the shape. The two expansion blocks are oriented so as to provide a linear segment in each quadrant between adjacent ends of each arcuate segment. Additional pairs of expansion blocks can be added for each quadrant to further expand the area to be enclosed. In all cases, the enclosed area is formed by placing adjacent blocks such that their edges engage each other to form a shape without the presence of gaps between adjacent blocks.

9 Claims, 5 Drawing Sheets

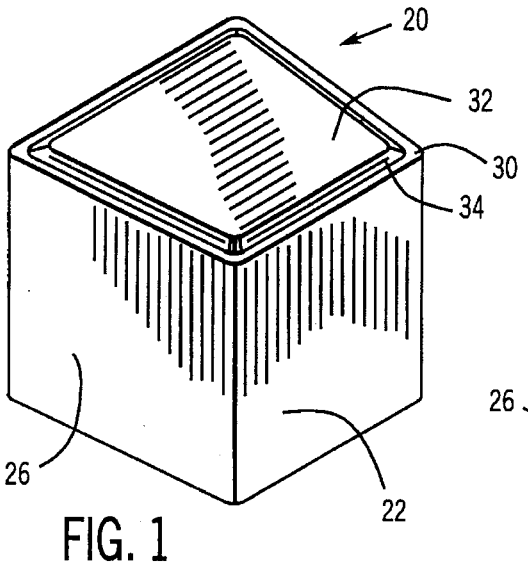
FIG. 1
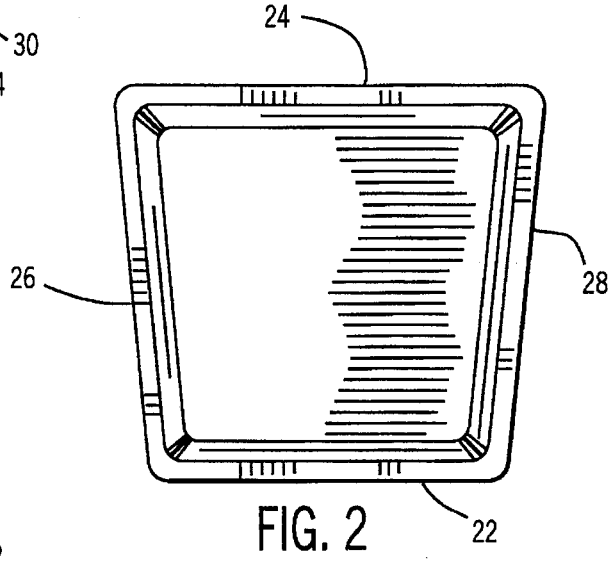
FIG. 2
FIG. 3
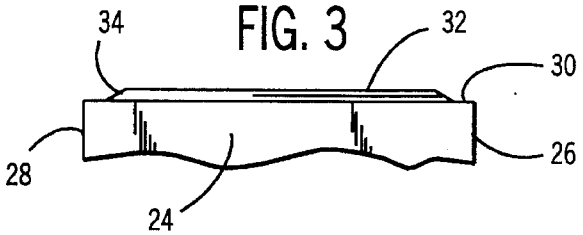
FIG. 4
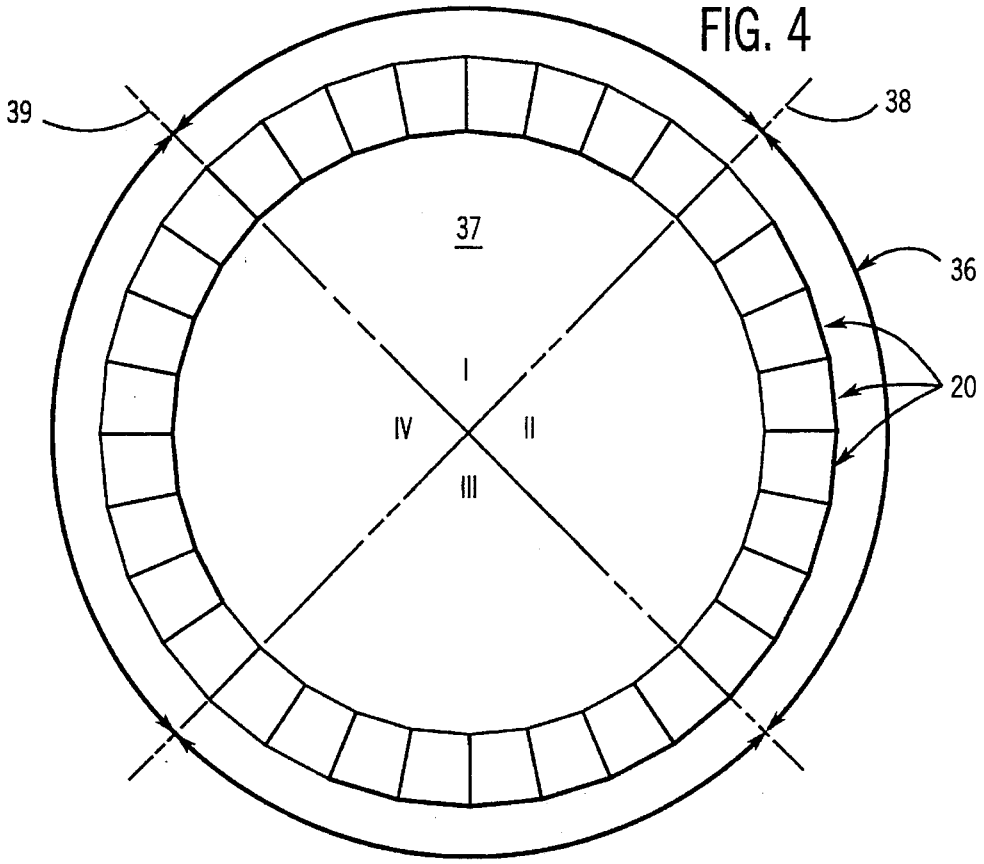

EDGING BLOCK, AND METHOD OF ENCLOSING AN AREA UTILIZING A SERIES OF EDGING BLOCKS

BACKGROUND AND SUMMARY OF THE INVENTION

This invention relates to an edging block and a method of enclosing or bordering an area using a series of side-by-side edging blocks.

Various configurations of concrete blocks or stones are known for edging, bordering or paring an area. Such blocks are commonly rectangular in plan, which functions well to form a linear edge, border or pavement area. However, this known construction is not satisfactory to form an edge, border or paved area which is curved, since this can only be done by placing the blocks such that a gap is located between adjacent blocks in the curved area. The gap between adjacent blocks must be filled using concrete, mortar, sand or the like in order to prevent soil from accumulating in the gap, which can otherwise result in vegetation growing between blocks.

It is an object of the present invention to provide a uniquely shaped edging or border block which is very well suited to construct a curved edge or border. It is a further object of the invention to provide a method of enclosing an area using such blocks which can be easily carried out by a do-it-yourself homeowner or by relatively unskilled laborers. A still further object of the invention is to provide a method of enclosing an area in which the area to be enclosed can be easily expanded while maintaining the general overall aesthetic appearance of the shape of the enclosed area.

In accordance with one aspect of the invention, a method of enclosing an area includes the steps of providing a predetermined number of blocks, with each block having inner and outer edges and a pair of angled side edges which diverge from each other in an inward-outward direction, and with the length of the inner wall of each block being less than that of the outer wall; and placing the blocks such that the side edges of the blocks engage each other and the inner edges of the blocks face toward the center of the area to be enclosed. In this manner, the inner and outer edges of adjacent blocks face in generally the same direction. The angle of the side edges of the blocks results in formation of a closed substantially circular shape without the presence of gaps between adjacent blocks. The number of blocks provided is divisible by four, and an equal number of blocks is located in each quadrant of the circular shape.

In accordance with another aspect of the invention, the area enclosed by the shape formed according to the foregoing steps is expanded by adding a pair of expansion blocks in each quadrant of the shape, the expansion blocks being constructed identically to the blocks used to form the circular shape, and orienting at least one of the expansion blocks differently than the remaining blocks in the quadrant to provide a substantially linear segment for each quadrant. The step of orienting at least one of the expansion blocks in each quadrant differently than the remaining blocks can be carried out by placing one of the expansion blocks such that its outer edge faces inwardly toward the center of the enclosed shape and its inner edge faces outwardly. In this arrangement, the side edges of the differently oriented expansion block engage the facing side edges of the adjacent blocks. Alternatively, the pair of expansion blocks in each quadrant can be oriented such that either their inner edges or outer edges face each other and their side edges face inwardly and outwardly, with the non-facing inner or outer edges engaging the side edges of the adjacent blocks.

In accordance with another aspect of the invention, an edging or border block, for use in enclosing an area as set forth above, has an inner edge, an outer edge and a pair of side edges which diverge from each other in an inward-outward direction. The inner edge has a width substantially equal to 3.29 inches, the outer edge has a width substantially equal to 4.00 inches, and the block has a depth substantially equal to 3.625 inches. The inner and outer edges are substantially parallel, so as to provide the block with a substantially trapezoidal shape. The side edges are angled at approximately 5.625° relative to a line perpendicular to the inner and outer edges.

In accordance with a still further aspect of the invention, a non-closed border can be formed of linear segments and/or curved segments. A curved segment is formed by orienting the inner and outer edges of adjacent blocks in the same general direction, whereas a linear segment is provided by orienting the inner and outer edges of adjacent blocks in opposite directions.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of an edging or border block constructed according to the invention;

FIG. 2 is a top plan view of the block of FIG. 1;

FIG. 3 is a partial side elevation view of the block of FIG. 1;

FIG. 4 is a top plan view of a substantially circular enclosed shape formed by placing a predetermined number of blocks constructed as in FIG. 1 in a side-by-side manner;

DETAILED DESCRIPTION OF THE INVENTION

Figure 5:
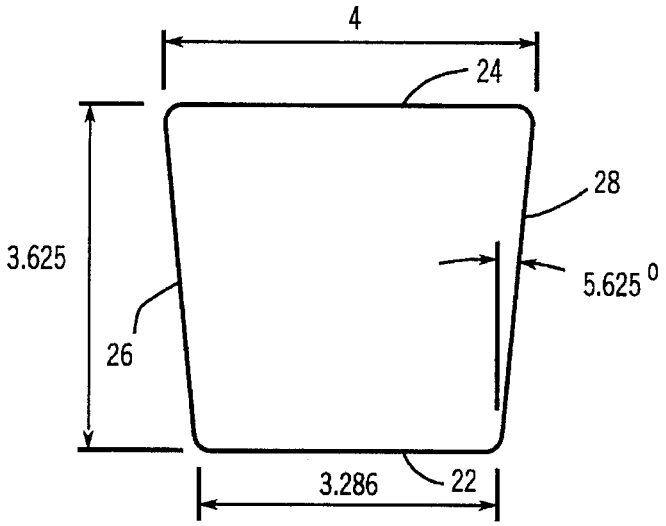
FIG. 5 is a top plan view showing the outline of the block of FIG. 1 and its specific dimensions.

Referring to FIGS. 1–3, a block 20 constructed according to the invention includes an inner planar edge or wall 22, an outer planar edge or wall 24, and a pair of planar side edges or walls 26, 28. Block 20 is generally trapezoidal in plan, with inner and outer edges 22, 24 lying in generally parallel planes. Side edges 26, 28 are angled so as to diverge from each other in a direction from inner edge 22 toward outer edge 24. With this construction, the width of inner edge 22 is less than that of outer edge 24.

Block 20 further defines a substantially flat planar bottom surface, and an upper surface which defines a peripheral lip 30, an inner raised surface 32, and a peripheral bevel 34 extending between lip 30 and raised surface 32.

The plan view dimensions of block 20 are illustrated in FIG. 5. As shown, inner edge 22 has a width of 3.286 inches, and outer edge 24 has a width of 4.00 inches. Block 20 is 3.625 inches deep, and side edges 26, 28 diverge from each other at an angle of 5.625° relative to a line perpendicular to inner and outer edges 22, 24. Side edges 26, 28 thus diverge at an angle of 10.25° relative to each other. In addition, the height of block 20 is 4.00 inches.

FIG. 4 illustrates a series of blocks 20 which are placed in a side-by-side manner to form a generally circular ring-like shape 36 which encloses a generally circular area 37. Ring 36 may be used for any purpose, such as in a landscape application in which a tree or the like is located within enclosed area 37. In a landscaping application such as this, each of blocks 20 is buried such that only its upper surfaces 30–34 are exposed. If desired, ring 36 may be slightly raised relative to the surrounding ground by burying each block 20 such that a portion of the upper area of each edge 22–28 is also exposed.

Figure 6:
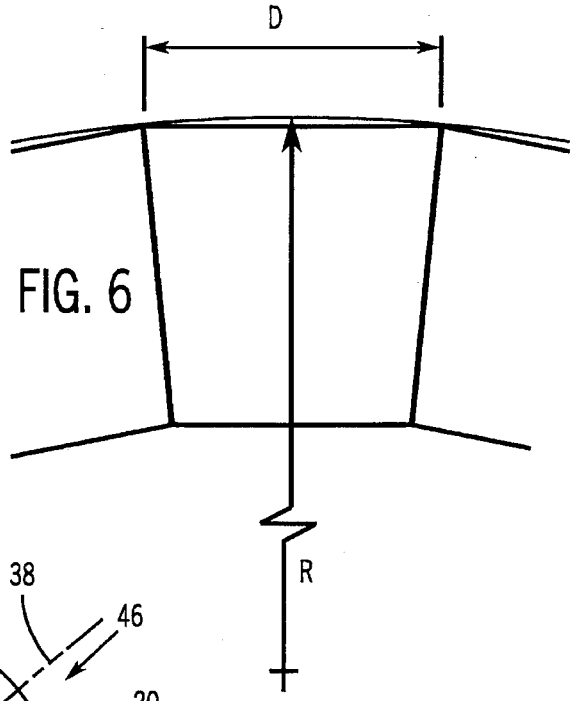
FIG. 6 is a top plan view of a portion of the enclosed shape of FIG. 4.

The dimensions of block 20 as set forth above with reference to FIG. 5 are such that placing 32 blocks 20 in the manner as illustrated in FIG. 4 forms circular ring 36. Each block 20 is placed such that its inner edge 22 faces inwardly toward the center of area 38 and outer edge 24 of each block 20 faces outwardly. Side edge 26 of each block 20 faces and engages side edge 28 of the adjacent block 20. The angle of edges 26, 28, along with the external dimensions of block 20, are such that, when 32 blocks 20 are placed as shown in FIG. 4 a ring 36 having an outside radius of 20.40 inches and an inside radius of 16.00 inches (FIG. 6) is formed, without the presence of gaps between adjacent blocks 20. The inner and outer edges of ring 36, defined by inner and outer block edges 22, 24, respectively are continuous and spaced a constant distance from each other throughout the periphery of ring 36.

FIG. 4 shows ring 36 divided into four quadrants, denoted I, II, III and IV, by perpendicular axes 38, 39. Eight blocks are located in each of quadrants I–IV. Consequently, the eight blocks in each quadrant form a 90° arcuate segment of shape 36, i.e. the side edges 26, 28 of the end blocks in each quadrant are perpendicular to each other.

Figure 7:
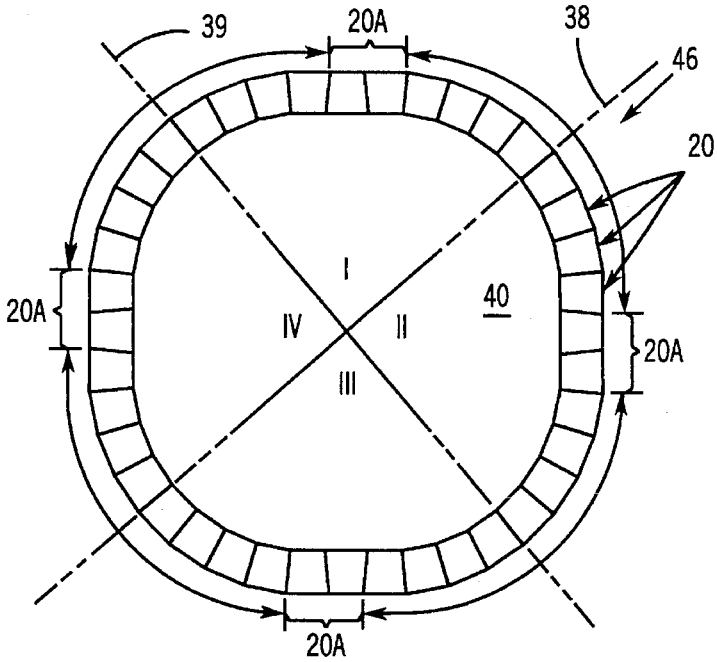
FIGS. 7–9 are top plan views similar to FIG. 4 showing expansion of the enclosed shape over that of FIG. 4 by adding additional pairs of expansion blocks for each quadrant.
Figure 8:
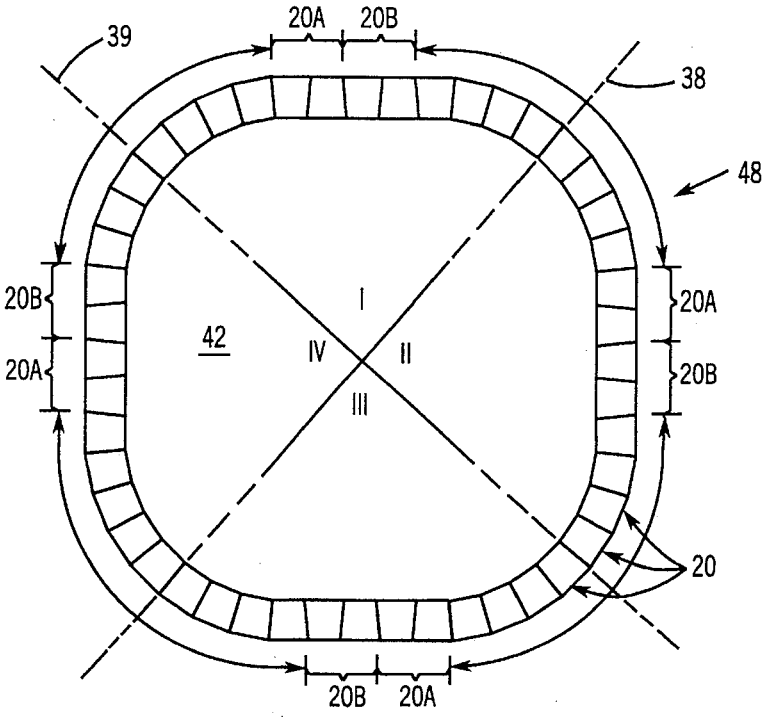
Figure 9:
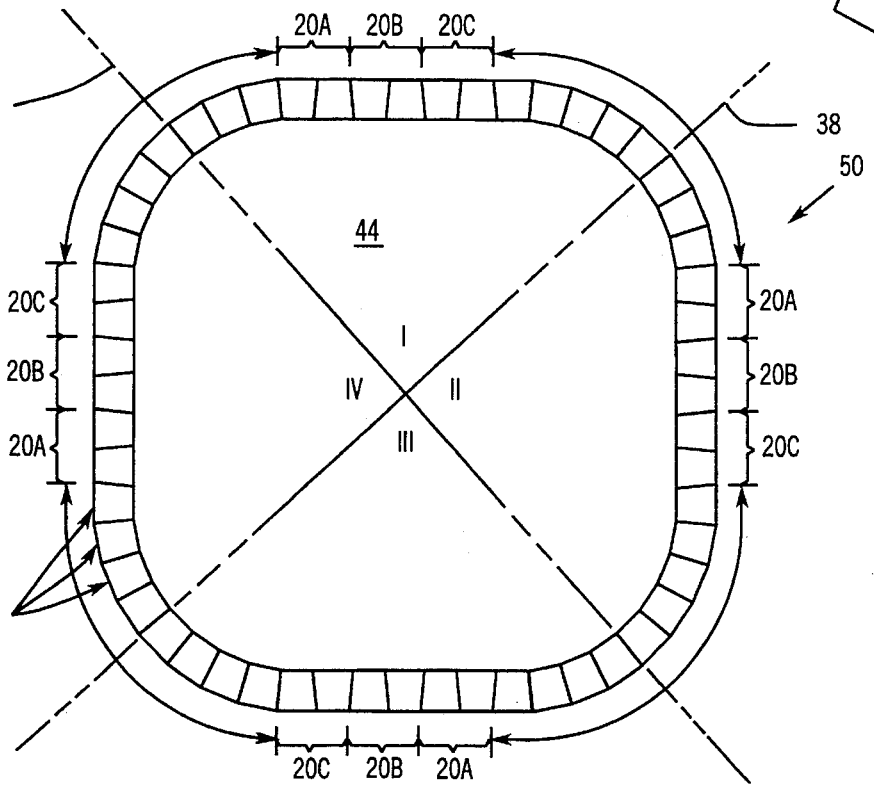

FIG. 7–9 illustrate areas 40, 42 and 44, respectively, which are enclosed by a series of blocks 20. The arrangement of blocks enclosing areas 40, 42 and 44 illustrates a method by which the area enclosed by blocks 20 can be gradually increased with respect to the enclosed circular area 38 (FIG. 4).

The block shape 46 enclosing area 40 of FIG. 7 differs from ring 36 of FIG. 4 in that, for each of quadrants I–IV of area 40 to be enclosed, a pair of expansion blocks **20*a* are added. Expansion blocks 20*a* are constructed identically to original blocks 20. The orientation of one of expansion blocks 20*a* is reversed with respect to the remaining original blocks 20 in the quadrant and with respect to the other expansion blocks 20*a*. Thus, the total number of blocks forming shape 46 is 40. Essentially, the 32 original blocks which were used to form ring 36 are positioned similarly when forming ring 36 in that 4 similarly oriented blocks 20 are disposed on each side of the intersection of axes 38, 39 with shape 46. However, ring 36 is essentially "broken" at 4 equally spaced locations and the two expansion blocks 20*a* are therein inserted. Each set of blocks 20*a* forms a linear segment in one of quadrants I–IV. The linear segments are located at 90° relative to each other so as to be equally radially spaced about the periphery of shape 46**.

As shown in FIG. 8, two additional expansion blocks **20*b* are added to each of quadrants I–IV in order to expand the area 42 enclosed by shape 48 over area 40 formed by shape 46. Again, expansion blocks 20*b* are connected identically to blocks 20, and one of expansion blocks 20*b* is oriented such that its outer edge 24 faces inwardly toward the center of area 42 and its inner edge 22 faces outwardly. The two additional expansion blocks 20*b* are added to expansion blocks 20*a* as illustrated in FIG. 7, in order to increase the length of the linear segment in each of quadrants I–IV between arcuate sections, which again are common as between circular ring 36 of FIG. 4 and shape 46 of FIG. 7. However, it is understood that expansion blocks 20*b* could also be satisfactorily inserted between adjacent blocks in one of the arcuate segments and not contiguous with expansion blocks 20*a***.

FIG. 9 illustrates a further enlarged area 44 enclosed by a series of blocks forming a shape 50 in which two additional expansion blocks **20*c* are added to each of quadrants I–IV in order to expand area 44 over areas 40 and 42. Again, expansion blocks 20*c* are constructed identically to blocks 20, and one of expansion blocks 20*c* is oriented such that its outer edge 24 faces inwardly toward the center of area 42 and its inner edge 22 faces outwardly. As with shapes 46 and 48, shape 50 constitutes 4 arcuate segments corresponding to the equally divided quadrants of ring 36, with linear segments disposed therebetween. Again, it is understood that expansion blocks 20*c*** could also be satisfactorily inserted between adjacent blocks in one of the arcuate segments.

In each of shapes 46, 48 and 50 shown in FIGS. 7–9, the inner and outer edges of the shape are continuous and spaced a constant distance from each other throughout the periphery of the shape.

It is also understood that additional pairs of expansion blocks such as **20*a*, 20*b* and 20*c*** could be added to further increase the length and/or number of linear segments forming the closed shape to further expand the enclosed area beyond that shown in the drawing figures.

Figure 10:
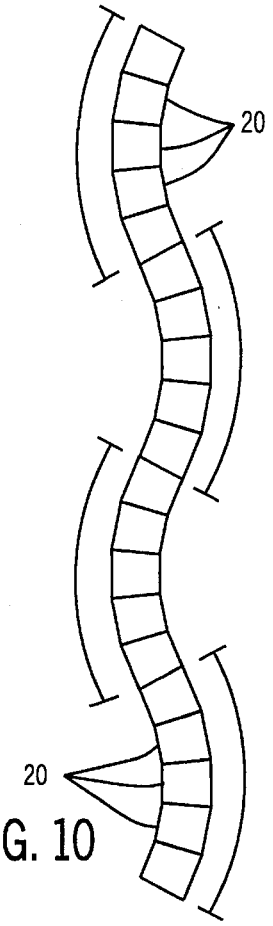
FIG. 10 is a top plan view of a serpentine section formed utilizing a series of side-by-side blocks constructed as in FIG. 1.

FIG. 10 illustrates a series of blocks 20 placed so as to form a serpentine border or edge. In this arrangement, a first segment of 5 blocks 20 is oriented such that their inner edges 22 face a common direction, to form an arcuate segment. A second series of blocks 20 are placed such that their inner edges 22 face a common direction opposite that of the first segment of blocks. Third and fourth block segments are placed similarly to the first and second segments, respectively, so as to provide an alternate curvature to the edge or border. It is understood that any desired number of consecutive oppositely oriented blocks may be placed between the defined arcuate segments, or any other arcuate segment, to form a linear segment, as desired.

Figure 11:
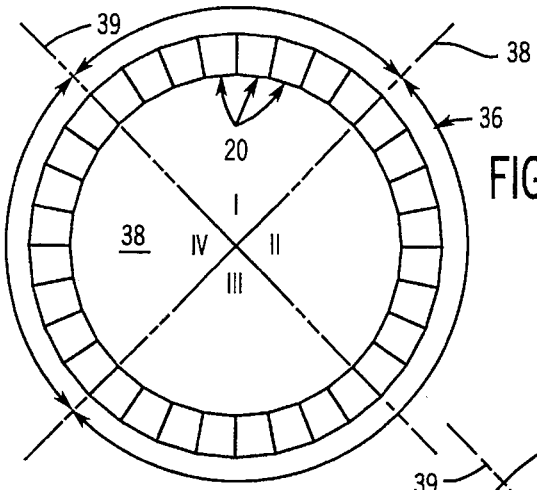
FIG. 11 is a view similar to FIG. 4.
Figure 12:
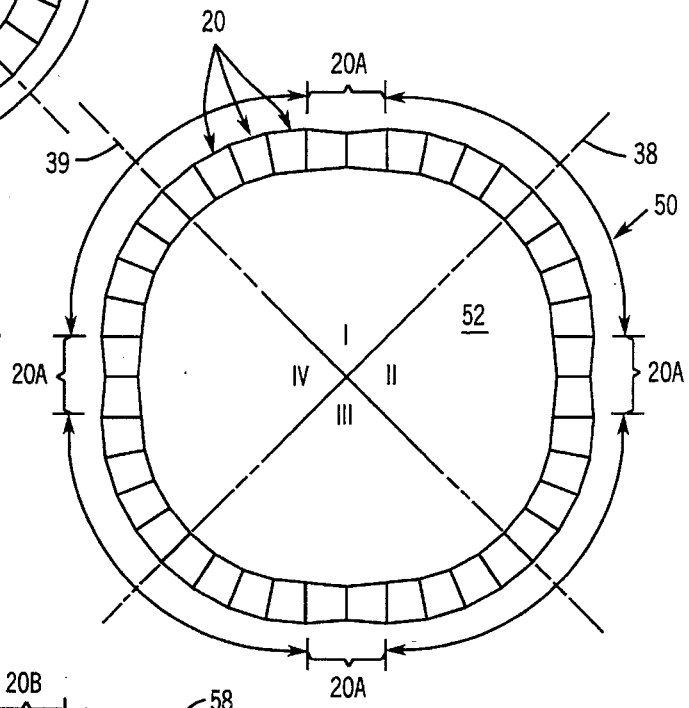
FIGS. 12–14 are views similar to FIGS. 7–9 showing an alternative arrangement for expanding the enclosed shape over that of FIG. 11 by adding additional pairs of expansion blocks for each quadrant.
Figure 13:
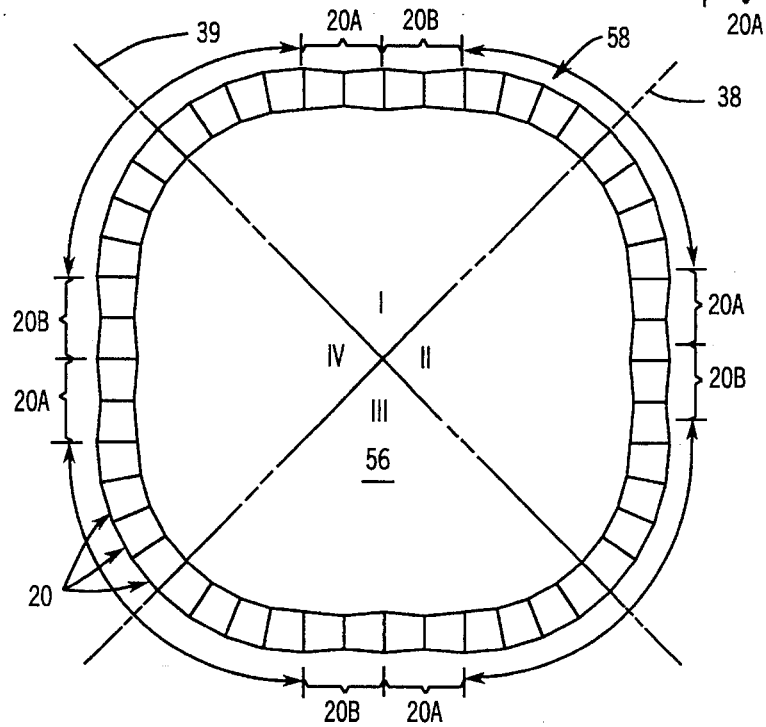
Figure 14:
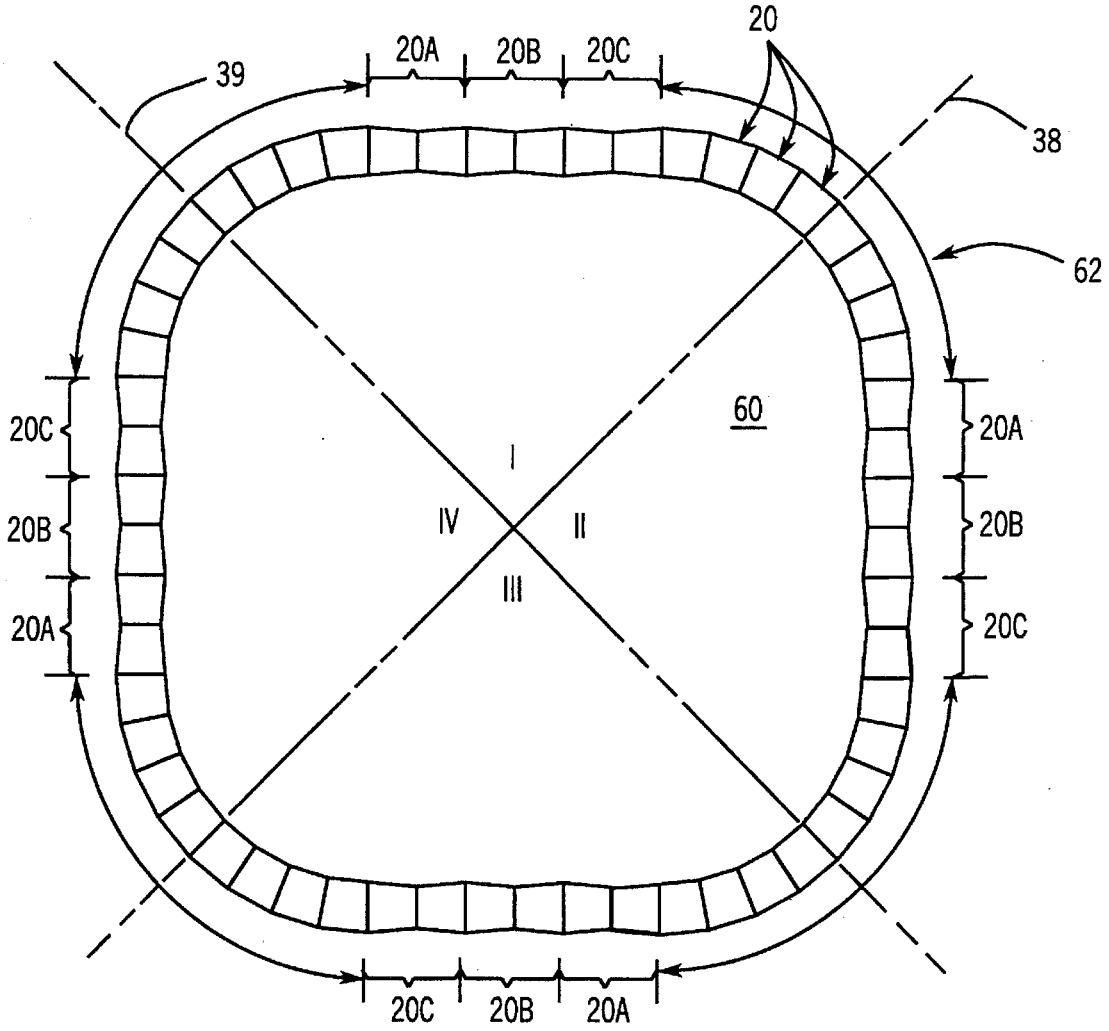

FIG. 11 shows ring 36, and FIG. 12–15 illustrate an alternate method for expanding the area enclosed by blocks 20. In this arrangement, area 52 (FIG. 12), which is larger than substantially circular area 37, is defined by a shape 54 formed by positioning two expansion blocks **20*a* per quadrant forming a linear segment between the four arcuate segments of ring 36. In this arrangement, the two expansion blocks 20***a* are placed such that their side edges 26, 28 face inwardly and outwardly, and their inner edges 22 face and engage each other. The outer edges 24 of expansion blocks 20*a* engage side edges 26, 28 of the end blocks in each arcuate segment. FIG. 13 illustrates an area 56, larger than area 52, formed by a shape 58 in which two expansion blocks 20*b* per quadrant are turned sideways along with and contiguous to expansion blocks 20*a*, as in FIG. 12, to increase the length of each linear segment. FIG. 14 illustrates a still larger area 60 enclosed by a shape 62 which is formed by adding two expansion blocks 20*c* per quadrant turned sideways along with and contiguous to expansion blocks 20*a*, 20*b*, as in FIG. 13, to further increase the length of each linear segment between adjacent arcuate segments.

Again, the inner and outer edges of shapes 54, 58 and 62 are continuous and spaced a constant distance from each other throughout the periphery of each shape.

As before, it is understood that expansion blocks 20*b*, 20*c* could be placed between adjacent blocks in the arcuate segments, and do not necessarily have to be contiguous with each other nor with expansion blocks 20*a*.

Figure 15:
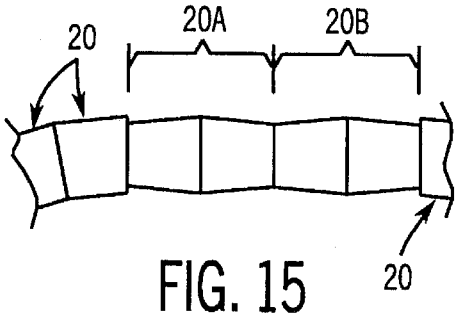
FIG. 15 is a partial top plan view showing an alternate orientation for the expansion blocks used to expand the enclosed shapes of FIGS. 12–14.

FIG. 15 partially illustrates the expansion method as in FIG. 13. In this arrangement, however, the blocks forming the linear segment are turned such that the inner edges 22 of the end blocks in each linear segment engage the side edges 26, 28 of the end blocks in each arcuate segment. The outer edges 24 of the endmost blocks in the linear segment engage the outer edges 24 of the central block 20 in the linear segment, and the inner edges 22 of the central blocks face and engage each other. This same block orientation could be used for any or all of expansion blocks 20*a*, 20*b* or 20*c*.

It can thus be appreciated that the blocks 20 are uniquely dimensioned so as to enable an area of ever increasing size to be enclosed by adding two additional blocks for each quadrant of the area to be enclosed, and orienting the at least two additional blocks differently than the remaining blocks which form arcuate segments of the shape enclosing the area. Blocks 20 are of a size small enough to enable them to be easily handled. Blocks 20 provide a highly efficient and satisfactory edging and bordering system while at the same time enabling a homeowner or landscaping customer to use the same block for enclosing an area.

Various alternatives and embodiments are contemplated as being within the scope of the following claims particularly pointing out and distinctly claiming the subject matter regarded as the invention.

I claim:

1. A block, comprising:

a first end edge, a second end edge, and a pair of side edges which diverge from each other in a direction from the first end edge toward the second end edge;

wherein the first end edge has a width substantially equal to 3.29 inches, the second end edge has a width substantially equal to 4.00 inches, and the block has a depth substantially equal to 3.625 inches, wherein the side edges diverge at an angle of 11.25° relative to each other.

2. The block of claim 1, wherein the first add second end edges are substantially parallel to provide the block with a substantially trapezoidal shape.

3. The block of claim 2, wherein the side edges are angled at approximately 5.625° relative to the first and second end edges.

4. A method of enclosing an area using blocks as defined in claim 1, comprising the step of placing 32 blocks such that the side edges of adjacent blocks face and engage each other and the first end edge of each block faces toward the center of the area, wherein the blocks cooperate to define a substantially circular shape without the presence of gaps between adjacent blocks.

5. A method of expanding the area enclosed as set forth in claim 4, comprising the steps of providing a pair of expansion blocks for each quadrant of the area to be enclosed, and orienting at least one of the expansion blocks in each quadrant differently than the remaining blocks in the quadrant to provide a substantially linear segment for each quadrant, wherein the blocks provide an enclosed area without the presence of gaps between adjacent blocks.

6. A method of enclosing an area, using the blocks as defined in claim 11 comprising the steps of:

providing 32 of said blocks, approximately 5.625° relative to a line perpendicular to the block; and placing the blocks adjacent each other such that the first end edge of each block faces the center of the area and the facing side edges of adjacent blocks engage each other, and wherein the blocks are placed such that an equal number of blocks are located in each quadrant of the area.

7. A method of expanding the area enclosed as set forth in claim 6, comprising the step of providing a pair of expansion blocks for each quadrant of the area to be enclosed, wherein the expansion blocks are constructed substantially identically to the first-mentioned blocks, and orienting one of the expansion blocks in each quadrant such that its second end edge faces toward the center of the area and its first end edge faces away from the center of the area.

8. The method of claim 7, further comprising the step of orienting one or more additional expansion blocks in each quadrant such that its second end edge faces toward the center of the area and its first end edge faces away from the center of the area and, for each additional expansion block in each quadrant, orienting another expansion block such that its first end edge faces toward the center of the area and its second end edge faces away from the center of the area.

9. A method of expanding the area enclosed as set forth in claim 6, comprising the step of providing a pair of expansion blocks for each quadrant of area to be enclosed, wherein the expansion blocks are constructed substantially identically to the first-mentioned blocks, and orienting the pair of expansion blocks such that one side edge of each expansion block faces toward the center of the area and the other side edge of each expansion block faces away from the center of the area.

* * * * *

UNITED STATES PATENT AND TRADEMARK OFFICE

CERTIFICATE OF CORRECTION

PATENT NO. : 5,564,240

DATED : October 15, 1996

INVENTOR(S) : STEVEN J. HENDERSON ET AL

It is certified that error appears in the above-indentified patent and that said Letters Patent is hereby corrected as shown below:

Title page, item [56] References Cited, add: -- "Product Guide", UNILOCK, International Blvd., Brewster, New York, 10509, PM 592 Unilock, Ltd., date unknown --; -- Verlegebeispiele, Eskoo-Rialta Brochure, pages 9-10, date unknown --; -- Hanover Architectural Products, Inc. Brochure, 240 Bender Road, Hanover, PA 17331, PB-1993, pages 15-16, 1993 --.

Claim 2, column 6, line 1, delete "add" and substitute therefor -- and --; Claim 6, column 6, line 22, after "area" delete ","; Claim 6, column 6, line 23, after "11" insert -- , --; Claim 6, column 6, line 24, after "blocks" delete ",".

Signed and Sealed this

Seventeenth Day of December, 1996

*Attest:*

Bruce Lehman

BRUCE LEHMAN

*Attesting Officer*

*Commissioner of Patents and Trademarks*